United States Patent [19]

Lautenschlager et al.

[11] 4,154,343

[45] May 15, 1979

[54] SEE-THROUGH PACKAGING FOR FURNITURE HINGES

[75] Inventors: Karl Lautenschlager; Horst Lautenschlager, both of Reinheim, Fed. Rep. of Germany

[73] Assignee: Karl Lautenschlager KG, Reinheim, Fed. Rep. of Germany

[21] Appl. No.: 850,455

[22] Filed: Nov. 10, 1977

[30] Foreign Application Priority Data

Dec. 11, 1976 [DE] Fed. Rep. of Germany ..... 2656225

[51] Int. Cl.[2] ..... B65D 77/26

[52] U.S. Cl. ..... 206/459; 33/197; 206/230

[58] Field of Search ..... 206/459, 230; 220/345, 220/346, 351; 33/197, 194, 185 R, 180 R, 174 G, 174 H

[56] References Cited

U.S. PATENT DOCUMENTS

| | | | |
|---|---|---|---|
| 292,463 | 1/1884 | Bassett | 33/197 |
| 664,910 | 1/1901 | Voight | 33/197 |
| 2,605,892 | 8/1952 | Waker | 220/345 |
| 2,634,507 | 4/1953 | Boatwright | 33/197 |
| 3,127,986 | 4/1964 | Hulka | 206/459 |
| 3,180,697 | 4/1965 | Mulch | 220/345 |
| 3,615,004 | 10/1971 | Wescott | 206/459 |

FOREIGN PATENT DOCUMENTS

| | | | |
|---|---|---|---|
| 1148328 | 6/1957 | France | 220/351 |

*Primary Examiner*—Herbert F. Ross

[57] ABSTRACT

See-through packaging for the self-service sale of furniture hinges in small quantities, consisting of a plastic box of appropriate size serving for the accomodation of the hinges, having a rectangular or square bottom and sidewalls projecting upwardly at right angles from the bottom, and being closeable by a cover of transparent plastic material. One of the sidewalls of the box has a lower height in comparison to the other sidewalls, and a flat wall section extending downwardly from the cover closes the opening formed above the wall of lower height. The cover is constructed as a marking template or drilling guide for the door part and/or the supporting wall part of the hinges contained in the box, by providing holes at a distance from the inner surface of the wall section of the cover which corresponds to the distance measured from the corresponding door edge at which the bore or bores are to be located in the cabinet door for the door part of the hinge and/or to the distance or distances measured from the front edge of the supporting wall at which a bore or bores are to be provided in the cabinet supporting wall for the supporting wall part of the hinge.

13 Claims, 1 Drawing Figure

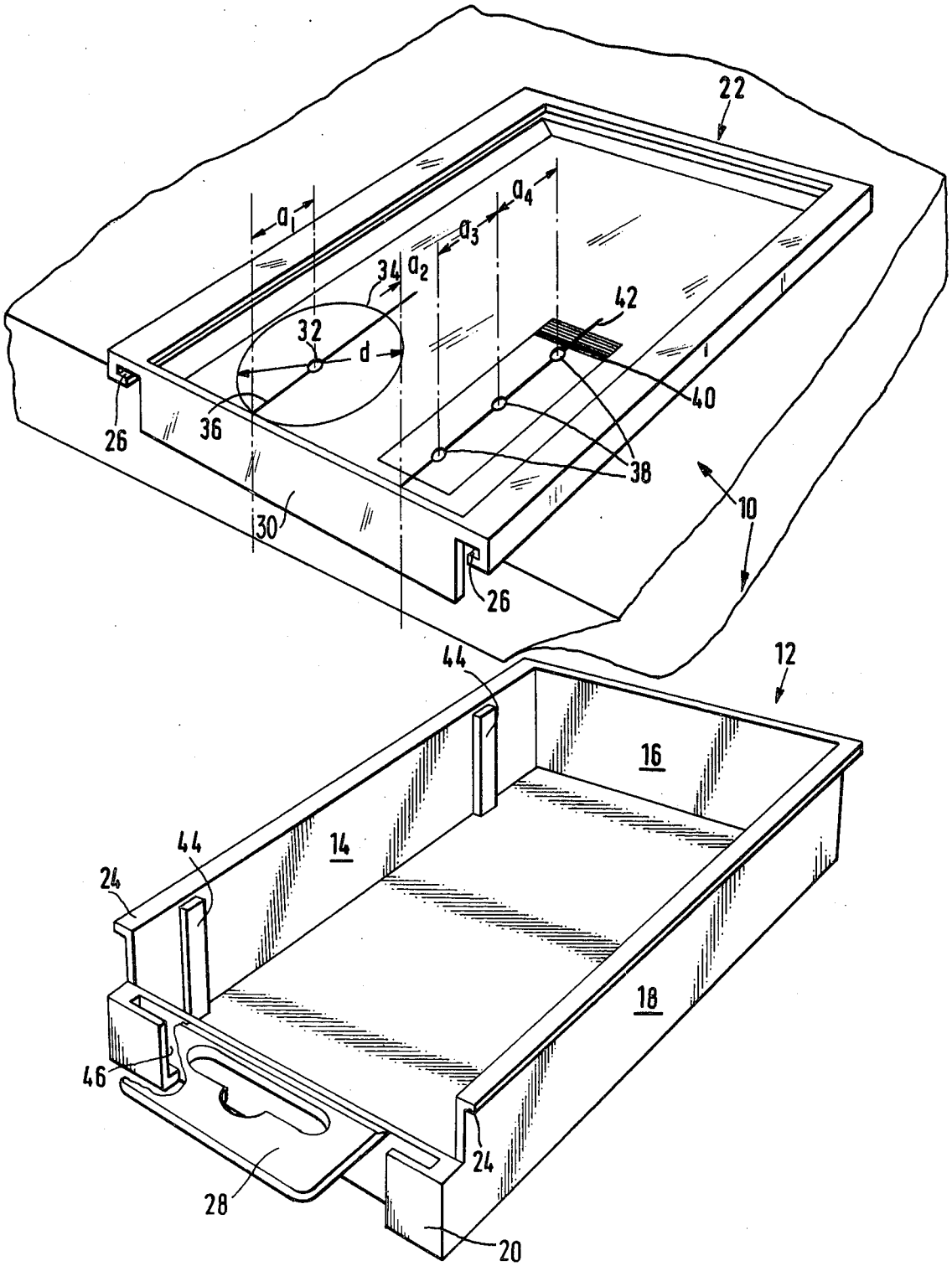
22
$a_1$
$a_4$
$a_3$
34
$a_2$
42
32
d
40
26
36
38
10
30
26
12
44
16
44
14
24
18
46
24
28
20

SEE-THROUGH PACKAGING FOR FURNITURE HINGES

BACKGROUND

The invention relates to a see-through packaging for the self-service sale of furniture hinges in small quantities, consisting of a plastic box of suitable size for the accommodation of the hinges and, if desired, of the appropriate fasteners, having a rectangular or square bottom and sidewalls extending upwardly at right angles from the bottom, and being closed by a cover of transparent plastic material.

Such see-through packages are used in many forms and designs for the self-service sale of small hardware or fittings, the packages often having also a hanger tab whereby they can be hung on suitable self-service racks such that their content is visible through the cover made of transparent plastic.

Cabinet hinges, especially the modern cantilever or cross-link hinges for float-out doors, have hitherto been sold to private individuals only to a small extent, since their correct installation on the supporting wall of the cabinet and on the corresponding door requires great care and precise workmanship if the door is to be correctly mounted after installation. In furniture factories the installation of hinges is performed with precision devices whose cost is prohibitive for private individuals who engage only occasionally in the construction of cabinets.

However, since the number of hobbyists who undertake even difficult work is increasing, cantilever hinges and other modern types of hinges are being purchased to an increasing degree by private individuals. But in order that the hinges may be installed correctly, precise instructions and layout diagrams for their installation must accompany them in their package.

It is the object of the invention, therefore, to create a see-through package for self-service sale of modern cabinet hinges which will facilitate the installation of the hinges by being designed as templates for the bores to be made in the furniture for such hinges. This is to serve the purpose of preventing faulty installation due to misunderstanding of instructions, and of facilitating the marking or drilling of the necessary mounting holes in the precisely correct locations.

Setting out from a see-through package of the initially mentioned kind, this object is achieved by the invention in that one of the sidewalls of the plastic box has a reduced height in comparison to the other sidewalls, that at the margin of the cover associated with this sidewall a flat wall section projecting downwardly at right angles is provided, which when the cover is in the proper closed position on the box closes the opening formed above the sidewall of reduced height, and that the cover is thereby formed into a marking or drilling template for the door part and/or wall part of the hinges contained in the box, that holes are provided at a distance from the inner surface of the wall section of the cover, which corresponds to the distance measured from the corresponding door edge at which the holes are to be drilled in the door for the door part of the hinge and/or to the distance or distances measured from the front edge of the supporting wall at which the holes are to be drilled in the cabinet supporting wall for the supporting wall part of the hinge. The inside of the downwardly projecting wall section of the cover thus serves as a reference surface that can be placed against the edge of the cabinet door or front edge of the supporting wall, as the case may be, and the bores to be drilled for the mounting screws of the parts of the hinge can be marked through the holes in the cover. In many cases the cover will be usable directly as a drilling template, since the holes in the cover will certainly suffice for the small amount of drilling to be done, even if the cover is made of relatively delicate plastic material.

To facilitate the user's decision as to which holes in the cover relate to which part of the hinge, provision is made in further development of the invention, that the outline of a plan view of the part of the hinge that is to be installed is marked on the cover in correct alignment with the corresponding holes in the cover.

Since the cover template of the invention gives only the precise distance of the mounting holes from the door edge or from the front edge of the supporting wall, the vertical level at which the hinge is to be mounted must still be measured and marked by hand. This dimension, however, is not critical. Now, in order to assure that the cover template will also be placed at the correct height, provision is made in an advantageous further development of the invention for the marking of straight locating lines on the cover at right angles to the inside of the downwardly projecting wall section, these lines passing through the centers of the hole or holes in the cover and running from the particular cover hole to the inside of the alignment tab. If these locating lines are aligned with the previously measured and marked heights, one has the assurance that the screw holes to be marked or drilled will be at the correct height.

The marking of the outline of the hinge part and of the locating lines are preferably cast in relief or intaglio in the plastic material. Alternatively, they can be printed on the cover.

In addition, instructions for the mounting of the hinges can be imprinted by molding or printing on the cover and/or on the inside of the bottom of the plastic box. This has the advantage over separately printed mounting instructions that they cannot be lost.

The invention will be further explained hereinafter in conjunction with the drawing which represents a see-through package of the invention in a perspective representation, with the cover removed from the box and shown in a raised position.

The see-through package designated as a whole by the number 10 is composed of a box 12 of rectangular plan having sidewalls 14, 16, 18 and 20 projecting upwardly at right angles, and being made of a plastic such as polystyrene, for example, and a cover 22 made of preferably transparent plastic, also polystyrene, for example. The upper edges of the longer sidewalls 14 and 18 are provided with narrow, outwardly projecting lips 24 on which the cover 22, which is provided on each of its longer edges with a groove 26 of a size and shape complementing the lips, can be slid. This construction of the cover 22 as a sliding cover is, however, shown only by way of example. The cover could just as well be contructed as one that can be snapped onto the box or as one that is hinged to the upper edge of one of the side-walls.

The box 12 furthermore has a hanger tab 28, which is known in itself, formed in one piece with it by injection molding; the tab can also be a break-away tab.

The shorter sidewall 20 of box 12, which is the front sidewall in the drawing, has a lower height than the other sidewalls 14, 16 and 18, so that between its upper edge and a flat cover placed on the box 12, a horizontal opening would remain. This opening, however, is filled by a flat downwardly projecting wall section 30 of the cover 22, so that hinge parts or screws or the like, contained in the package, will be unable to fall out.

Let it be assumed that the see-through package 10 of the invention is intended for the packaging of two or three cantilever hinges, of which the door part is in the form of a cup to be inserted or hammered into a circular recess in the door, while the supporting wall part is formed by an elongated support arm which would be attached to the supporting wall by means of a mounting plate which is to be fastened to the supporting wall with three screws. Such hinges are shown for instance in Assignee's co-pending applications Ser. Nos. 722,433 and 780,783, respectively, filed Sept. 13, 1976 and Mar. 24, 1977, now U.S. Pat. Nos. 4,065,829 and 4,091,498, respectively, and application Ser. No. 740,980, filed Nov. 11, 1976. Thus, for each hinge a recess of circular plan has to be made in the back of the door by means of a router or special drill and must be located at a precisely prescribed distance from the adjacent door edge. Furthermore, the three pilot bores for the fastening of the mounting plate must be made at a precisely determined distance from the front edge of the support wall.

The hole 32 in the upper flat side of the cover 22, which side is slightly recessed below the edges of the cover, serves for the precise marking of the center of the recess for the cup, hole 32 being provided precisely at the distance $A_1$ from the inside of the downwardly projecting wall section 30 which corresponds to the prescribed distance from the outside edge of the door to the center of the recess for the cup of the hinge. Hole 32 is surrounded by a ring 34 printed on the cover or formed thereon by injection molding, which indicates by its shape that the hole which it surrounds is the center point marking hole for the recess for the door part of the hinge. Also, the dimension d can be printed or molded on the cover 22 for the purpose of indicating the diameter of the router bit or special drill required.

At right angles to the wall section 30 there is also a printed or molded reference line 36 extending centrally through the hole 32, which permits the precise alignment of the cover 22 with a height mark previously made on the door, when the cover 22 is used as a marking template.

The holes 38 provided on the right-hand side of the drawing adjacent the hole 32 in the flat side of the cover mark the precise distances $A_2$, $A_3$, $A_4$ at which the screw holes provided in the supporting wall for the mounting plate must be located from the front edge of the supporting wall. In this case, again, the outline 40 of the mounting plate and a locating line 42 running through the center of the holes 38 at right angles to the marginal projection 30 is provided by printing or molding. The marking of the centers for the pilot bores to be drilled in the supporting wall is performed in the same manner as described previously in conjunction with the marking of the center for the recess for the door part of the hinge. Alternatively, the holes 38 can also be used directly as drilling templates, i.e., the drill bit held in the chuck of a portable electric drill for making the pilot holes for the mounting plate can be fitted directly through the holes 38, after the template has been correctly located, and then the drill is turned on and the pilot hole is drilled.

It is clear that the location of the holes 38 and the distances of the holes 32 and 38 from the inside of the marginal projection 30 must correspond to the dimensions required for the hinges packed in the box. This means that the box 12 can be used for hinges of many different forms, but that a special cover has to be provided for each type of hinge whose installation dimension differ from those of other types of hinges.

The see-through package 10 of the invention can, like other known see-through packages, be used afterwards as storage boxes for small parts. The upright strips 44 represented on the inside of the sidewall 14, which terminate just below the upper edge of this sidewall, form supports for a similar box having correspondingly dimensioned (not shown) projections or the like on the underside of its bottom, i.e., the boxes 12 are stackable. When such boxes are stacked without lids in place (which is also possible, fundamentally speaking), the opening on the front, which as stated previously, was closed by the marginal projection 30 of the cover 22, will remain open permitting a view of and access to the interior of the box.

Furthermore, in the front side of the low wall 20, a slot 46 diagrammatically indicated below the breakaway hanger tab 28, can be provided for a piece of paper or cardboard of corresponding dimensions, on which the content of the box 12 can be written.

We claim:

1. A see-through package for furniture hinges having a door part and a support wall part to be fastened in at least one bore of the door or the support wall of a cabinet, comprising:

a box for accommodating the hinges having a substantially rectangular or square bottom with a plurality of side walls projecting upwardly at right angles from said bottom, and a substantially flat cover of transparent plastic material having a flat surface for closing said box, one of said side walls of said box having a lower height than the other side walls to thereby leave an opening, said cover having an edge and a flat wall section extending downwardly at right angles from said edge and closing said opening when said cover is placed on said box, at least one bore being provided in said flat surface of said cover at a distance from the surface of said flat wall section which faces said box, said distance corresponding to the distance measured from the edge of the door or support wall at which said bore is to be located, whereby said cover forms a marking template or drilling jig for at least one bore for fastening said parts contained in said box.

2. The package according to claim 1, wherein said at least one bore in the cover is located at a distance from the inside surface of said flat wall section which corresponds to the distance measured from the side edge of the cabinet door to the position at which said fastening bore for the door part of the hinge is to be provided.

3. The package according to claim 1, wherein said at least one bore in the cover is located at a distance from the inside surface of said flat wall section corresponding to the distance measured from the front edge of the supporting wall of the cabinet to the positionat which said fastening bore for the supporting wall part of the hinge is to be provided in the cabinet supporting wall.

4. A see-through package according to claim 1, wherein a plan view of the hinge parts is marked on the cover in correct alignment with the corresponding respective bore in the cover.

5. A see-through package according to claim 1, wherein reference lines are marked on said cover extending at right angles to said inside surface of said flat wall section of the cover and centrally through the cover bore and wherein said lines extend up to the inside surface.

6. A see-through package according to claim 4, wherein said outline is molded into the plastic material of said cover in relief.

7. A see-through package according to claim 4, wherein said outline is molded into the plastic material of said cover in intaglio.

8. A see-through package according to claim 5, wherein said lines are molded into the plastic material of said cover in relief.

9. A see-through package according to claim 5, wherein said lines are molded into the plastic material of said cover in intaglio.

10. A see-through package according to claim 4, wherein said outline is printed onto said cover.

11. A see-through package according to claim 5, wherein said lines are printed onto said cover.

12. A see-through package according to claim 1, wherein instructions for the installation of the hinge are provided in the plastic material of said cover.

13. A see-through package according to claim 1, wherein instructions for the installation of the hinge are provided in the plastic material of the inside of said bottom.

* * * * *